US008899952B2

(12) United States Patent
Sagawa

(10) Patent No.: US 8,899,952 B2
(45) Date of Patent: Dec. 2, 2014

(54) SINTERED MAGNET PRODUCING APPARATUS

(75) Inventor: Masato Sagawa, Kyoto (JP)

(73) Assignee: Intermetallics Co., Ltd., Gifu (JP)

( * ) Notice: Subject to any disclaimer, the term of this patent is extended or adjusted under 35 U.S.C. 154(b) by 89 days.

(21) Appl. No.: 13/321,607

(22) PCT Filed: May 20, 2010

(86) PCT No.: PCT/JP2010/058555

§ 371 (c)(1),
(2), (4) Date: Jan. 9, 2012

(87) PCT Pub. No.: WO2010/134578

PCT Pub. Date: Nov. 25, 2010

(65) Prior Publication Data

US 2012/0107433 A1 May 3, 2012

(30) Foreign Application Priority Data

May 22, 2009 (JP) ..... 2009-124377

(51) Int. Cl.

*B28B 1/00* (2006.01)
*H01F 41/02* (2006.01)
*C22C 26/00* (2006.01)

(52) U.S. Cl.

CPC ..... *H01F 41/0273* (2013.01); *C22C 2202/02* (2013.01); *B22F 2999/00* (2013.01); *H01F 41/028* (2013.01); *C22C 2026/002* (2013.01)
USPC ..... 425/3

(58) Field of Classification Search

USPC ..... 425/3
See application file for complete search history.

(56) References Cited

U.S. PATENT DOCUMENTS 5,672,363 A * 9/1997 Sagawa et al. ..... 425/3
6,602,352 B2 * 8/2003 Okumura et al. ..... 148/103

FOREIGN PATENT DOCUMENTS

| | | |
|---|---|---|
| JP | A-59-046008 | 3/1984 |
| JP | A-05-043904 | 2/1993 |
| JP | A-2006-019521 | 1/2006 |
| JP | A-2009-016849 | 1/2009 |
| JP | A-2009-164177 | 7/2009 |
| WO | WO 2009/084178 A1 | 7/2009 |

OTHER PUBLICATIONS

Chinese Office Action issued in Chinese Application No. 201080020741.6 dated Nov. 2, 2012 (w/translation).

(Continued)

*Primary Examiner* — Joseph S Del Sole
*Assistant Examiner* — John Robitaille
(74) *Attorney, Agent, or Firm* — Oliff PLC

(57) ABSTRACT

A sintered magnet producing apparatus is provided having a device for fixing a filling container and a lid for the container in the process of orienting alloy powder in the filling container by means of a magnetic field. The sintered magnet producing apparatus includes a filling system for supplying an alloy powder into a filling container and then compacting the alloy powder, a sintering device for sintering the alloy powder, an orienting device having a coil for generating a magnetic field for orienting the alloy powder in the filling and sintering container before the filling process and after the compacting process, and a fixing device for covering the filling container with a lid, and simultaneously, fixing the filling container only during the orienting process. The filling container is prevented from moving due to the magnetic field applied in the orienting process and, simultaneously, the scattering of the alloy powder is prevented.

10 Claims, 3 Drawing Sheets

(56) References Cited

OTHER PUBLICATIONS

Aug. 10, 2010 International Search Report issued in International Patent Application No. PCT/JP2010/058555 (with translation).

Dec. 12, 2011 International Preliminary Report on Patentability issued in International Patent Application No. PCT/JP2010/058555 (with translation).

Jun. 24, 2013 Second Office Action issued in Chinese Application No. 201080020741.6 with English-language translation.

Oct. 1, 2013 Notification of Reason for Rejection issued in Japanese Application No. 2009-124377 with English-language translation.

* cited by examiner

WHEN CARRYING FILLING CONTAINER IN OR OUT OF ORIENTING UNIT

DURING ORIENTING PROCESS

WHEN CARRYING FILLING CONTAINER IN OR OUT OF ORIENTING UNIT

DURING ORIENTING PROCESS

WHEN CARRYING FILLING CONTAINER IN OR OUT OF ORIENTING UNIT

DURING ORIENTING PROCESS

WHEN CARRYING FILLING CONTAINER IN OR OUT OF ORIENTING UNIT

DURING ORIENTING PROCESS

SINTERED MAGNET PRODUCING APPARATUS

TECHNICAL FIELD

The present invention relates to an apparatus for producing a sintered rare-earth magnet by a sintering process.

BACKGROUND ART

A rare-earth-iron-boron (hereinafter "RFeB") magnet, which was discovered by Sagawa (the inventor of the present invention) et al. in 1982, is characterized in that its properties are far superior to those of the previously used permanent magnets and yet it can be produced from relatively abundant, inexpensive materials, i.e. neodymium (a rare-earth element), iron and boron. Due to these merits, this magnet is currently used in various products, such as the voice coil motors for hard disk drives or similar devices, drive motors for hybrid cars or electric cars, motors for battery-assisted bicycles, industrial motors, high-quality speakers, head phones, and magnetic resonance imaging (MRI) apparatuses using permanent magnets.

Three methods have been known to be available for producing RFeB magnets: (1) a sintering method; (2) a method including the steps of casting, hot working and aging treatment; and (3) a method including the step of die upsetting of a quenched alloy. Among these methods, the sintering method is superior to the other two in terms of magnetic properties and productivity and has already been established on the industrial level. With the sintering method, a dense, uniform and fine structure necessary for permanent magnets can be obtained.

Patent Document 1 discloses a method for producing an RFeB magnet by a sintering method. A brief description of this method is as follows: Initially, an RFeB alloy is created by melting and casting. This alloy is pulverized into fine powder and filled into a mold. A magnetic field is applied to this alloy powder, while a pressure is applied to the powder with a pressing machine. In this manner, both the creation of a compressed compact and the orientation of the same compact are simultaneously performed. Subsequently, the compressed compact is removed from the mold and sintered by heat to obtain an RFeB sintered magnet.

Fine powder of an RFeB alloy is easily oxidized and can ignite by reacting with oxygen in air. Therefore, the previously described process should preferably be performed entirely in a closed container whose internal space is free from oxygen or filled with inert gas. However, this is impractical because creating the compressed compact requires a large-sized pressing machine capable of applying a high pressure of 400 kgf/cm$^2$ to 1000 kgf/cm$^2$ to the alloy powder. Such a pressing machine is difficult to be set within a closed container.

Patent Document 2 discloses a method for producing a sintered magnet without creating a compressed compact. This method includes the three processes of filling, orienting and sintering, which are performed in this order to create a sintered magnet. A brief description of this method is as follows: In the filling process, an alloy powder is supplied into a filling container, after which this container is covered with a lid. For this filling container with the lid, a tapping operation is repeated to compact the alloy powder in the container. In the orienting process, a pulsed magnetic field is applied to orient the alloy powder in the filling container with the lid in one direction. Unlike the technique disclosed in Patent Document 2, no pressure is applied to the alloy powder during this magnetic orienting process. Therefore, the particles of the alloy powder repulse each other due to the applied magnetic field, causing an increase in the volume of the powder. However, since the filling container is covered with the lid, the powder volume cannot exceed the capacity of the container. In the sintering process, the alloy powder which has been oriented in one direction in the orienting process is sintered by heat together with the filling container covered with the lid. By this method, since no pressure is applied to the alloy powder in the magnetic orienting process, the particles of the alloy powder undergo no restrictions in their orienting motion, so that an RFeB magnet with even higher magnetic properties can be obtained.

Patent Document 2 also discloses an apparatus for producing a sintered magnet using a closed container whose internal space is free from oxygen or filled with inert gas, in which a filling unit, an orienting unit and a sintering unit are provided together with a conveyer for moving the filling container from the filling unit to the orienting unit and then from the orienting unit to the sintering unit. In this apparatus, the alloy powder is handled under an oxygen-free or inert-gas atmosphere throughout the entire process, so that the oxidization of the powder and the deterioration of magnetic properties due to the oxidization will not occur.

BACKGROUND ART DOCUMENT

Patent Document

Patent Document 1: JP-A S59-046008
Patent Document 2: JP-A 2006-019521

DISCLOSURE OF THE INVENTION

Problem to be Solved by the Invention

In the apparatus disclosed in Patent Document 2, a lid is attached to the filling container and fixed to it by screwing, press-fitting or other methods to prevent the alloy powder in the filling container from scattering. However, the filling container itself is not fixed and can move due to the magnetic field applied in the orienting process. Such a movement of the filling container disturbs the oriented state of the alloy powder, which not only deteriorates the magnetic properties of the sintered magnet but also lowers the working efficiency of the production line.

Furthermore, in the orienting process, the magnetic field exerts a force on the alloy powder in the filling container, causing the powder particles to magnetically repulse each other and increase the volume of the powder. If the lid is insufficiently fixed, it will come off the container, allowing the alloy powder to be scattered. However, fixing the lid too tightly not only takes time to attach the lid but also impedes the removal of the lid after the sintering process, thus lowering the working efficiency of the production line.

The problem to be solved by the present invention is to provide a sintered magnet producing apparatus capable of preventing the disturbance of orientation and the scattering of the alloy powder, both phenomena causing the deterioration of magnetic properties, as well as preventing the lowering of the working efficiency of the production line.

Means for Solving the Problems

A sintered magnet producing apparatus according to the present invention aimed at solving the aforementioned problem includes:

a) a high-density filling system for filling a fine powder of an alloy into a filling container to a density within a range from 40 to 55% of a true density of the alloy;

b) an orienting device for orienting, by means of a magnetic field, the alloy powder as contained in the filling container;

c) a fixing device for covering the filling container with a lid to prevent the alloy powder in the filling container from being scattered, and for fixing the filling container at a predetermined position in the magnetic field, during an orienting process by the orienting device;

d) a sintering device for sintering the alloy powder by heating the alloy powder together with the filling container; and e) a conveyer for conveying the filling container among the high-density filling system, the orienting device and the sintering device.

An opening for supplying an alloy powder into the filling container is normally provided in the upper portion of the filling container. Accordingly, the fixing device should preferably be a device for vertically clamping the filling container to fix the position of the filling container and, simultaneously, cover the filling container with the lid. With such a device, it is possible to fix the filling container at a predetermined position in the magnetic field and simultaneously prevent the scattering of the alloy powder from the filling container.

The fixing device should preferably be made of a non-metallic material, such as plastic or ceramic. Such a choice of material prevents eddy current from occurring due to the application of an alternating magnetic field in the orienting process, and thereby prevents heat release or generation of an unwanted magnetic field due to the eddy current.

As the orienting device, a coil provided around the fixing device can be used.

The coil should preferably be arranged so that its axis extends parallel to a conveying direction of the filling container from the high-density filling system to the orienting device. This arrangement facilitates the operation of conveying the filling container to the orienting device and thereby improves the working efficiency of the production line.

In the process of orienting the alloy powder by a magnetic field, the magnetic field may be directed perpendicularly to an open face of the filling container. This configuration allows the filling container to have a cavity whose size and shape are close to those of the final product.

In one preferable mode of the present invention, the high-density filling system and the orienting device are contained in one closed container, and the closed container communicates with a furnace for sintering the alloy powder.

The orienting device may be a coil wound around the closed container.

Effect of the Invention

According to the present invention, the filling container is covered with a lid and, simultaneously, fixed at a predetermined position in the magnetic field by means of the fixing device in the orienting process, whereby the disturbance of orientation due to a movement of the filling container and the scattering of the alloy powder from the filling container are prevented. As a result, the magnetic properties of the sintered magnet are prevented from deterioration, and the lowering of the working efficiency of the production line is also prevented.

BEST MODE FOR CARRYING OUT THE INVENTION

One embodiment of the sintered magnet producing apparatus according to the present invention is hereinafter described by means of FIGS. 1-5B.

Embodiment

Figure 1:
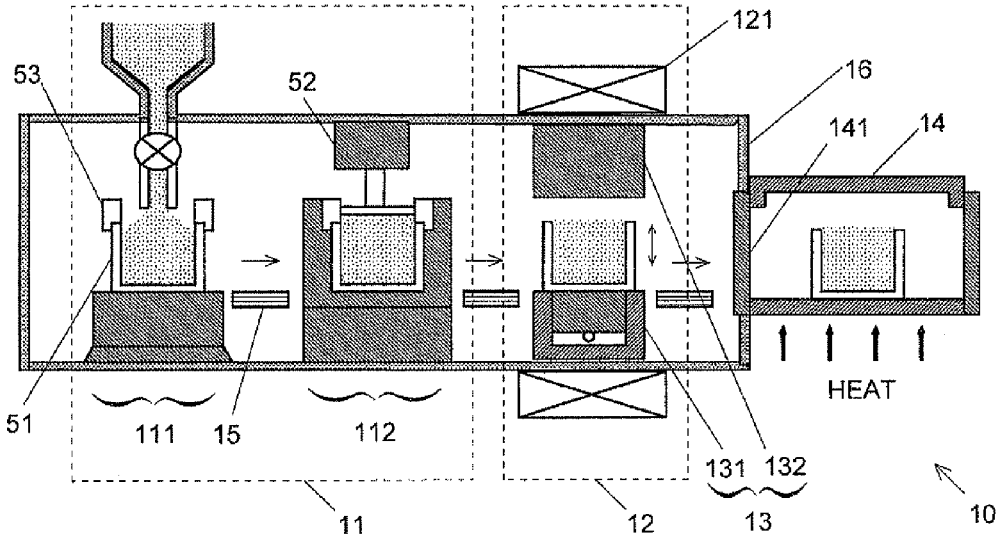
FIG. 1 is a schematic configuration diagram of one embodiment of the sintered magnet producing apparatus according to the present invention.

FIG. 1 shows an embodiment of the sintered magnet producing apparatus according to the present invention. This sintered magnet producing apparatus 10 includes: a filling unit 11 for filling an alloy powder into a filling container 51 and compacting the filled alloy powder; an orienting unit 12 for orienting the densely filled alloy powder in the filling container 51 by a magnetic field; a fixing unit 13 for covering the filling container 51 with a lid, and simultaneously, fixing the filling container 51 at a predetermined position in the orienting unit 12 only during the orienting process; and a sintering unit 14 for sintering the oriented alloy powder. This apparatus 10 also has a conveyer system 15 for conveying the filling container 51. Furthermore, the sintered magnet producing apparatus 10 has a closed container 16 for holding the filling unit 11, orienting unit 12, fixing unit 13 and conveyer system 15 under an oxygen-free or inert-gas atmosphere. These components will be hereinafter described in detail.

The filling unit 11 has a powder supplier 111 for supplying an alloy powder into the filling container 51 and a compacting section 112 for compacting the alloy powder supplied into the filling container 51. One example of the compacting unit 112 is a device which increases the filling density of the alloy powder to a level within a range from 40 to 55% of the true density of the alloy by covering the filling container 51 with a lid and tapping the filling container 51 on a table. However, in the present embodiment, a press cylinder 52 is used to compact the powder by applying a low pressure of several ten $kgf/cm^2$, e.g. within a range from 1 $kgf/cm^2$ to 50 $kgf/cm^2$. Applying the pressure in this manner is advantageous for improving the working efficiency since the pressing surface also functions as a lid for preventing the scattering of the alloy powder and eliminates the necessity of covering the filling container 51 with a lid piece by piece. A pressure of 1 $kgf/cm^2$ to 50 $kgf/cm^2$ can be easily achieved by a small-sized pressing machine. Therefore, the process of compacting the alloy powder can be performed inside the closed container 16. By contrast, in the case where a compressed compact is prepared to produce a sintered magnet as described in Patent Document 1, it is necessary to apply a high pressure of 400 $kgf/cm^2$ to 1000 $kgf/cm^2$ to create the compressed compact by a large-sized pressing machine, which is difficult to contain in the closed container 16.

For example, if a fine powder of NdFeB alloy having a true density of 7.6 $g/cm^3$, with an average particle size of approximately 3 μm, is naturally filled in the filling container 51 with a density of approximately 1.4 g/cm$^3$ (approximately 18% of the true density), the compacting unit 112 can increase its density to a level of 3.5 to 4.2 g/cm$^3$ (approximately 46 to 53% of the true density).

The orienting unit 12 has a coil 121 for generating a magnetic field. The coil 121 is wound around the outer wall of the closed container 16. The outer wall functions as the coil bobbin. Using the outer wall as the coil bobbin reduces the inner diameter of the coil and strengthens the generated magnetic field as compared to the case where a separate bobbin is provided around the outer wall.

The fixing unit 13 includes a cylinder 131 having a piston 1311 for vertically moving the filling container 51 placed thereon, and a pressure-receiving base 132 located above the piston 1311. The cylinder 131 and the pressure-receiving base 132 are made of a plastic material in order to prevent eddy current from occurring due to the magnetic field generated by the coil 121.

The sintering unit 14 is a sintering furnace for heating the filling container 51 as conveyed from the orienting unit 12. The internal space of the sintering furnace 14 communicates with the closed container 16. The inner spaces of the sintering furnace 14 and the closed container 16 can be maintained with an oxygen-free or inert-gas atmosphere. A heat-resistant door 141 is provided between the sintering furnace 14 and the closed container 16. During the heating process, this door 141 is closed to suppress an increase in the temperature inside the closed container 16 while maintaining the oxygen-free or inert-gas atmosphere in the sintering furnace 14.

The conveyer system 15 includes a belt conveyer for transferring the filling container 51 from the filling unit 11 to the sintering unit 14, and a manipulator (not shown) for moving the filling container 51 onto each unit. The belt conveyer 15 is made of a non-magnetic resin or similar material that will not affect the oriented alloy powder.

An operation of the sintered magnet producing apparatus 10 of the present embodiment is hereinafter described, taking the case of producing a sintered NdFeB magnet as an example.

Initially, in the filling unit 11, the filling container 51 is set in the powder supplier 111. The powder supplier 111, which has a weigher, supplies a predetermined amount of NdFeB alloy powder from a hopper into the filling container 51. At this stage, the bulk density of the powder is low since the filling density of the powder before being compacted is close to the natural filling density. Therefore, a guide 53 is attached to the upper end of the filling container 51 so that the predetermined amount of alloy powder can be supplied into the filling container 51. Next, in the compacting unit 112, the filling container 51 is pressed from above by the press cylinder 52. As already explained, the pressure applied from the press cylinder 52 is as low as several ten kgf/cm$^2$. By oscillating the filling container 51 under this pressure, the alloy powder in the filling container 51 can be densely and uniformly compressed. As a result, the alloy powder in the filling container 51 is pressed down to the level of the upper end of the container (the lower end of the guide). After that, the guide 53 is removed from the filling container 51.

Figure 2A:
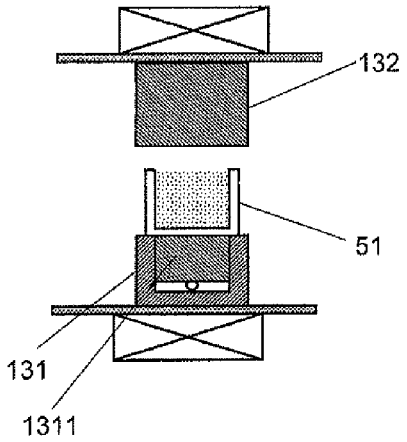
FIGS. 2A and 2B are vertical sectional views of the fixing unit in the sintered magnet producing apparatus of the present embodiment.
Figure 2B:
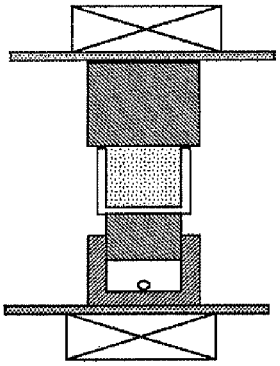

Next, the filling container 51 is conveyed from the filling unit 11 to the orienting unit 12 by the belt conveyer 15, and then transferred onto the top of the piston 1311 by the manipulator. As the piston 131 is moved upward, as shown in FIG. 2B, the filling container 51 placed on the piston 1311 is pressed onto the pressure-receiving base 32 and covered with the lower surface of the pressure-receiving base 132. In this stage, the filling container 51 is held between the piston 1311 and the pressure-receiving base 132 in such a manner that no pressure will be applied to the alloy powder in the filling container 51. Subsequently, while this state is maintained, an electric current is passed through the coil 121 to generate a magnetic field, whereby the alloy powder in the filling container 51 is oriented in one direction. After this orienting process is completed, the piston 131 is lowered.

The filling container 51 is finally conveyed into the sintering furnace 14, where the filling container 51 holding the alloy powder in the oriented state is heated to 950 to 1050 degrees Celsius to sinter the alloy powder. As a result, a sintered NdFeB magnet is obtained.

In the sintered magnet producing apparatus 10 of the present embodiment, the filling container 51 set in the orienting unit 12 is clamped between the piston 1311 and the pressure-receiving base 132 while a magnetic field is applied to the alloy powder. The filing container 51 is fixed relative to the orienting unit 12 in the magnetic field, and simultaneously, covered with the pressure-receiving base 132. In this manner, the filling container 51 is prevented from moving due to the force from the magnetic field, and simultaneously, the alloy powder is prevented from leaking from the filling container 51 and being scattered in the closed container 16.

In the sintered magnet producing apparatus 10 of the present embodiment, after an alloy powder is filled into the filling container 51, the production of the sintered magnet proceeds without covering the filling container 51 with a lid. Unlike the method disclosed in Patent Document 2, the step of attaching or removing a lid to or from the filling container 51 is omitted, whereby the working efficiency of the production line is further improved. In the present embodiment, the process of heating the alloy powder by the sintering furnace 14 is performed with no lid. However, the heating process may be performed with the filling container 51 covered with a lid. It is also possible to cover the filling container 51 with a lid in the compacting process and then perform the same operations as the present embodiment. In this case, the fixing unit 13 tightly holds both the filling container 51 and the lid during the orienting process, preventing the lid from coming off the filling container 51. Accordingly, the lid only needs to be loosely attached to the filling container 51; it is unnecessary to fix it by screwing, press-fitting or other methods. The lid can be easily removed after the sintering process. In this manner, the working efficiency is improved as compared to the conventional sintered magnet producing apparatus which has no fixing unit 13.

Figure 3A:
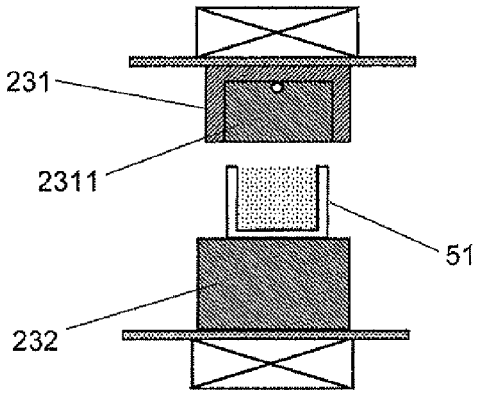
FIGS. 3A and 3B are vertical sectional views of a variation of the fixing unit in the sintered magnet producing apparatus of the present embodiment.
Figure 3B:
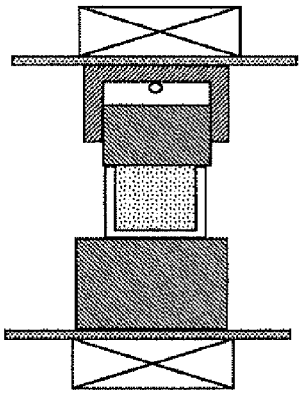

As shown in FIGS. 3A and 3B, the arrangement of the cylinder 231 and the pressure-receiving base 232 may be vertically inverted. In this case, the pressure-receiving base 232 also serves as the placing stage. Such an arrangement of the cylinder 231 and the pressure-receiving base 232 makes it unnecessary to vertically move the filling container 51 with the piston 2311. Therefore, the piston 2311 can fix the filling container 51 with an even weaker force.

Figure 4A:
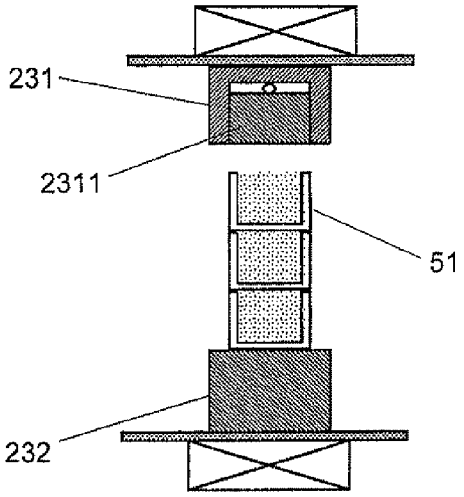
FIGS. 4A and 4B are vertical sectional views of the fixing unit in the case of simultaneously fixing a plurality of filling containers.
Figure 4B:
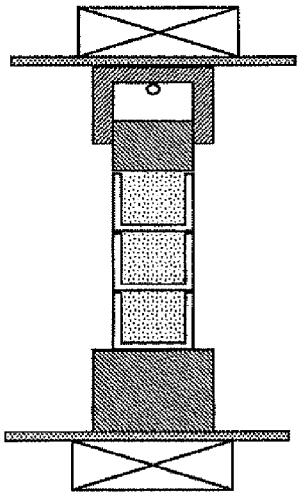

To further improve the working efficiency of the production line, it is possible to simultaneously orient the alloy powder filled in a plurality of filling containers 51 by means of the magnetic field in the orienting process. That is, as shown in FIGS. 4A and 4B, a plurality of the filling containers 51 of the same size can be vertically stacked and clamped from above and below, whereby all the filling containers are fixed, and simultaneously, the scattering of the alloy powder is prevented by the bottom surface of the filling container 51 located immediately above as well as by the lower surface of the cylinder 231.

Figure 5A:
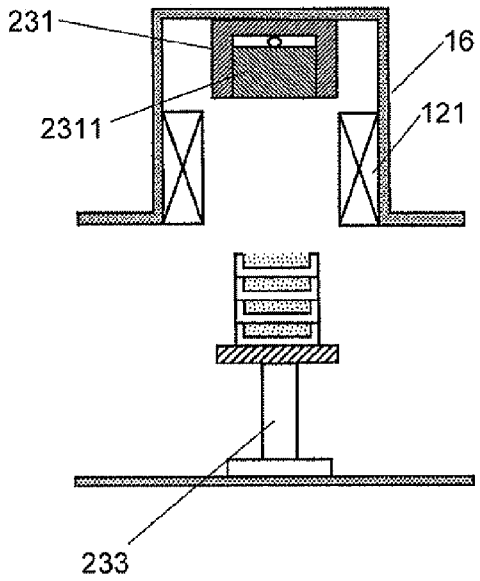
FIGS. 5A and 5B are vertical sectional views of the fixing unit in the case where the magnetic field is directed perpendicularly to the open faces of filling containers.
Figure 5B:
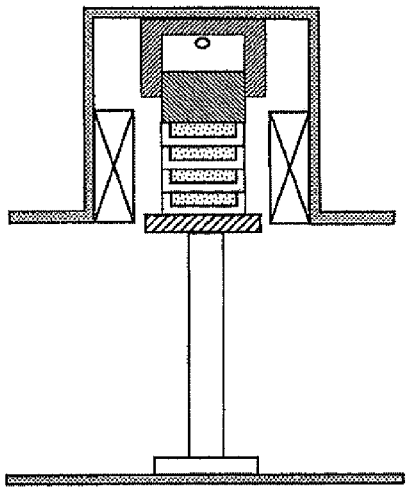

It is also possible to direct the magnetic field in the direction perpendicularly to the open face of the filling container 51 as shown in FIGS. 5A and 5B. In the configuration shown in FIGS. 5A and 5B, the coil 121 is provided in the upper portion of the closed container 16 to avoid interference with the conveyance of the filling container 51. Therefore, in the magnetically orienting process, it is necessary to move filling container 51 into the coil 121 by a lift 233. After the filling container 51 is moved into the coil 121, the filling container 51 is fixed by the cylinder 231, and the process of orienting the alloy powder in the filling container 51 is performed. After the orientation of the alloy powder is completed, the lift 233 is moved down, and then the filling container 51 is conveyed into the sintering furnace 14.

It should be noted that the producing method according to the present invention can be applied to the production of not only the RFeB magnets but also the RCo (rare-earth cobalt) magnets.

EXPLANATION OF NUMERALS

10 . . . Sintered Magnet Producing Apparatus
11 . . . Filling Unit
111 . . . Powder-Supply Unit
112 . . . Compacting Unit
12 . . . Orienting Unit
121 . . . Coil
13 . . . Fixing Unit
131, 231 . . . Cylinder
1311, 2311 . . . Piston
132, 232 . . . Pressure-Receiving Base
14 . . . Sintering Unit (Sintering Furnace)
141 . . . Door
15 . . . Conveying Unit (Belt Conveyer)
16 . . . Closed Container
233 . . . Lift
51 . . . Filling Container
52 . . . Press Cylinder
53 . . . Guide

The invention claimed is:

1. A sintered magnet producing apparatus, comprising:

a) a high-density filling system configured to fill a fine powder of an alloy into a filling container to a density within a range from 40 to 55% of a true density of the alloy;

b) an orienting device configured to orient, by means of a magnetic field, the alloy powder as contained in the filling container;

c) a fixing device configured to cover the filling container by moving the filling container to a lid or moving the lid to the filling container to prevent the alloy powder in the filling container from being scattered, and to fix the filling container at a predetermined position in the magnetic field, during an orienting process by the orienting device;

d) a sintering device configured to sinter the alloy powder by heating the alloy powder together with the filling container; and e) a conveyer configured to convey the filling container among the high-density filling system, the orienting device and the sintering device.

2. The sintered magnet producing apparatus according to claim 1, wherein the fixing is configured to fix the filling container by vertically clamping this container.

3. The sintered magnet producing apparatus according to claim 1, wherein the fixing device is made of a non-metallic material.

4. The sintered magnet producing apparatus according to claim 1, wherein the orienting device comprises a coil.

5. The sintered magnet producing apparatus according to claim 4, wherein the fixing device is provided within the coil.

6. The sintered magnet producing apparatus according to claim 4, wherein the coil is arranged so that its axis extends parallel to a conveying direction of the filling container from the high-density filling system to the orienting device.

7. The sintered magnet producing apparatus according to claim 1, wherein the magnetic field is directed perpendicularly to an open face of the filling container.

8. The sintered magnet producing apparatus according to claim 1, wherein after a plurality of the filling containers are conveyed from the high-density filling system, the fixing device is configured to simultaneously fix all of the plurality of the filling containers.

9. The sintered magnet producing apparatus according to claim 1, wherein the high-density filling system and the orienting device are contained in one closed container, and the closed container communicates with a furnace for sintering the alloy powder.

10. The sintered magnet producing apparatus according to claim 9, wherein the orienting device is a coil wound around the closed container.

* * * * *